US007650900B1

(12) United States Patent
Meyers

(10) Patent No.: US 7,650,900 B1
(45) Date of Patent: Jan. 26, 2010

(54) SYSTEM TO SUPPORT AND SERVICE YARD HYDRANTS

(76) Inventor: Gary F. Meyers, 10483 E. Township Road 124, Republic, OH (US) 44867-9641

( * ) Notice: Subject to any disclaimer, the term of this patent is extended or adjusted under 35 U.S.C. 154(b) by 677 days.

(21) Appl. No.: 11/520,839

(22) Filed: Sep. 14, 2006

(51) Int. Cl.
*E03B 9/04* (2006.01)

(52) U.S. Cl. ..... 137/15.08; 137/272; 137/294; 137/377

(58) Field of Classification Search ..... 137/294, 137/272, 15.02, 15.08, 377
See application file for complete search history.

(56) References Cited

U.S. PATENT DOCUMENTS 2,598,708 A * 6/1952 McGarry et al. ..... 137/282
4,634,313 A 1/1987 Robbins
D300,555 S 4/1989 Patterson
4,827,969 A 5/1989 Lyasko
4,861,248 A 8/1989 Ben
5,119,862 A 6/1992 Maimets et al.
5,211,685 A * 5/1993 Garcia ..... 137/377
5,769,112 A * 6/1998 Rendina ..... 137/272
6,019,136 A 2/2000 Walsh et al.
6,684,900 B1 2/2004 McKeague
2002/0166594 A1 11/2002 Waddleton

* cited by examiner

*Primary Examiner*—Kevin L Lee

(57) ABSTRACT

This patent discloses a support structure for a yard hydrant. The support structure may include a casing, a cap, a cap clamp, a first spacer, a second spacer, and a second spacer clamp. The casing may have a first end and a second end, where the first end includes a first cutout and a second cutout that may fit about a supply line for the yard hydrant. The cap may around a riser pipe of the yard hydrant and the cap clamp may secure the cap to the second end of the casing. The first spacer and second spacer of the support both may fit within the casing and fit about a nipple of the yard hydrant. The first spacer may be supported by a joint in the supply line and the second spacer may be supported by a second spacer clamp fixed about the nipple.

13 Claims, 5 Drawing Sheets

SYSTEM TO SUPPORT AND SERVICE YARD HYDRANTS

BACKGROUND

1. Field of Endeavor

The description relates to yard hydrants and more particularly to a system to support and service a yard hydrant.

2. Background Information

A hydrant is an outlet from a fluid main often consisting of an upright pipe with a valve attached from which fluid such as water or fuel may be tapped. An adjective, such as fire, water, and yard may be added to the term hydrant to characterize the type of fluid involved.

Utility yard hydrants are similar to common household water spigots except that yard hydrants usually are located far away from any structure and the yard hydrant has a different construction. Yard hydrants provide clean water to various locations during all seasons of the year, including when the temperature drops below freezing. Typically, they are manufactured and installed in such a way that they will operate throughout the winter without auxiliary heat being supplied to the yard hydrant.

In particular to the installation, a valve end of the yard hydrant is buried underground to a depth typically of at least three feet. Many city ordinances dictate varying soil composition and compact requirements. Complying with the city ordinance usually requires hiring a contractor and is difficult and expensive.

Yard hydrants are essential to farms, rural household locations, and other remote locations. They provide running water for livestock, lawns, and garden from a pressurized water supply pipe line connected to a main water service line. Where these outdoor hydrants are exposed to freezing temperatures, the hydrant sometimes becomes frozen.

Should a yard hydrant freeze, prudence requires that the frozen yard hydrant be thawed as soon as possible to avoid damage. If the yard hydrant is frozen below ground level, the yard hydrant head assembly conventionally is removed have to be removed and hot water poured down the inside of the riser pipe. This usually is accomplished by soldering a copper tube to a funnel and pouring the hot water through the funnel and tube to the point inside the riser pipe where the ice has formed. The tube is pushed down the riser pipe as the ice melts. This is a time consuming, cumbersome, and exhausting task, especially during the freeze of winter when a yard hydrant typically freezes.

A frozen riser pipe may burst. When the riser pipe bursts, the yard hydrant must be replaced. Conventionally, to replace the yard hydrant, the dirt around the valve portion of the hydrant first must be dug up. Then, the old hydrant is unscrewed from the supply line, the new hydrant is installed, and the dirt is filled back in and compacted to meet city ordinance requirements. This is a time consuming and exhausting task, especially during the freeze of winter when a yard hydrant typically bursts.

What is needed is system to more easily support a yard hydrant and reduce the effort needed to replace a broken yard hydrant.

SUMMARY

This patent discloses a support structure for a yard hydrant. The support structure may include a casing, a cap, a cap clamp, a first spacer, a second spacer, and a second spacer clamp. The casing may have a first end and a second end, where the first end includes a first cutout and a second cutout that may fit about a supply line for the yard hydrant. The cap may around a riser pipe of the yard hydrant and the cap clamp may secure the cap to the second end of the casing. The first spacer and second spacer of the support both may fit within the casing and fit about a nipple of the yard hydrant. The first spacer may be supported by a joint in the supply line and the second spacer may be supported by a second spacer clamp fixed about the nipple.

DETAILED DESCRIPTION

Figure 1:
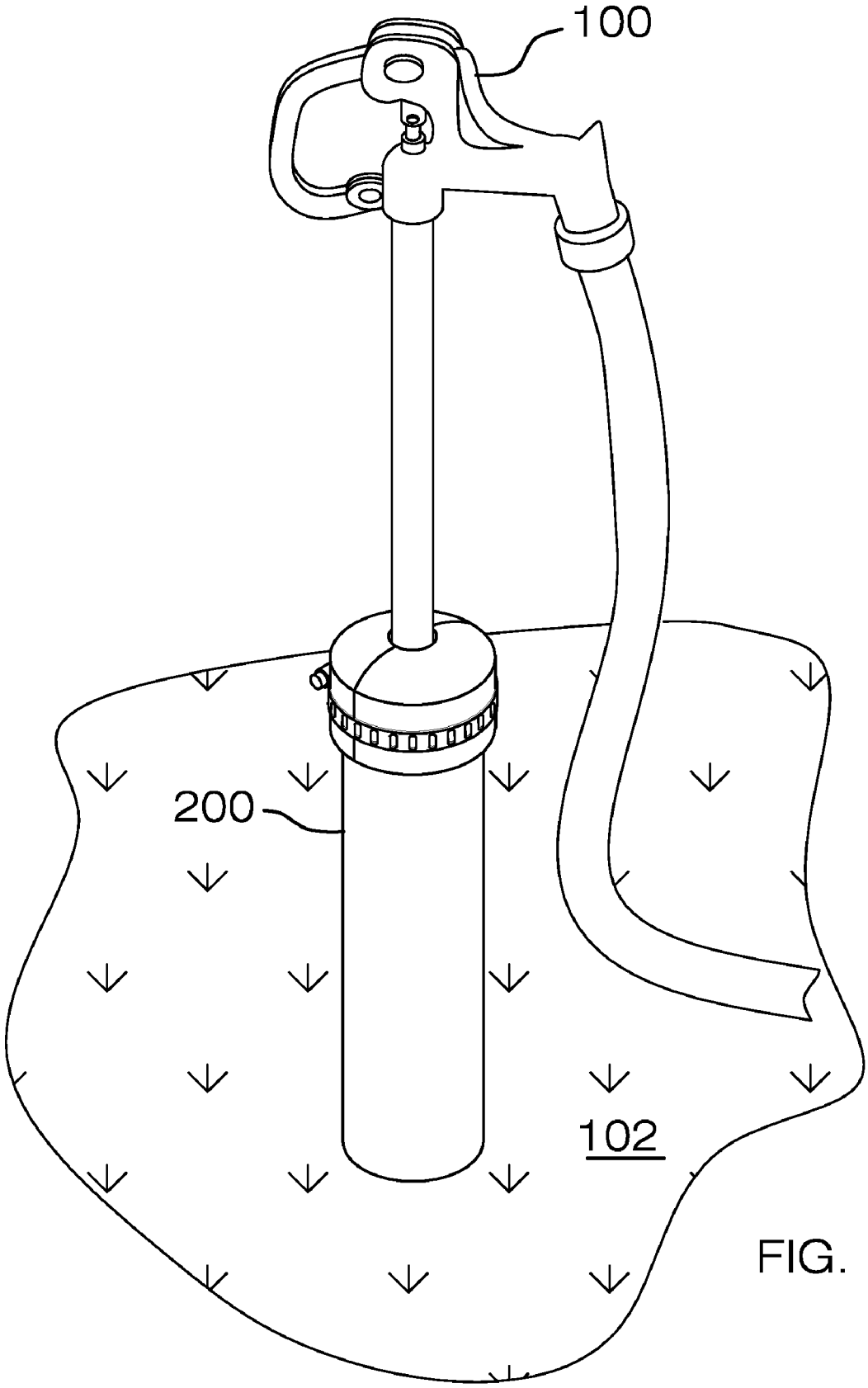
FIG. 1 is an isometric view of a support structure 200 for a yard hydrant 100.

FIG. 1 is an isometric view of a support structure 200 for a yard hydrant 100. Support structure 200 may provide a stabilizing support for yard hydrant 100 as well as permit yard hydrant 100 to be replaced without a need to dig up ground 102 from around yard hydrant 100.

Figure 2:
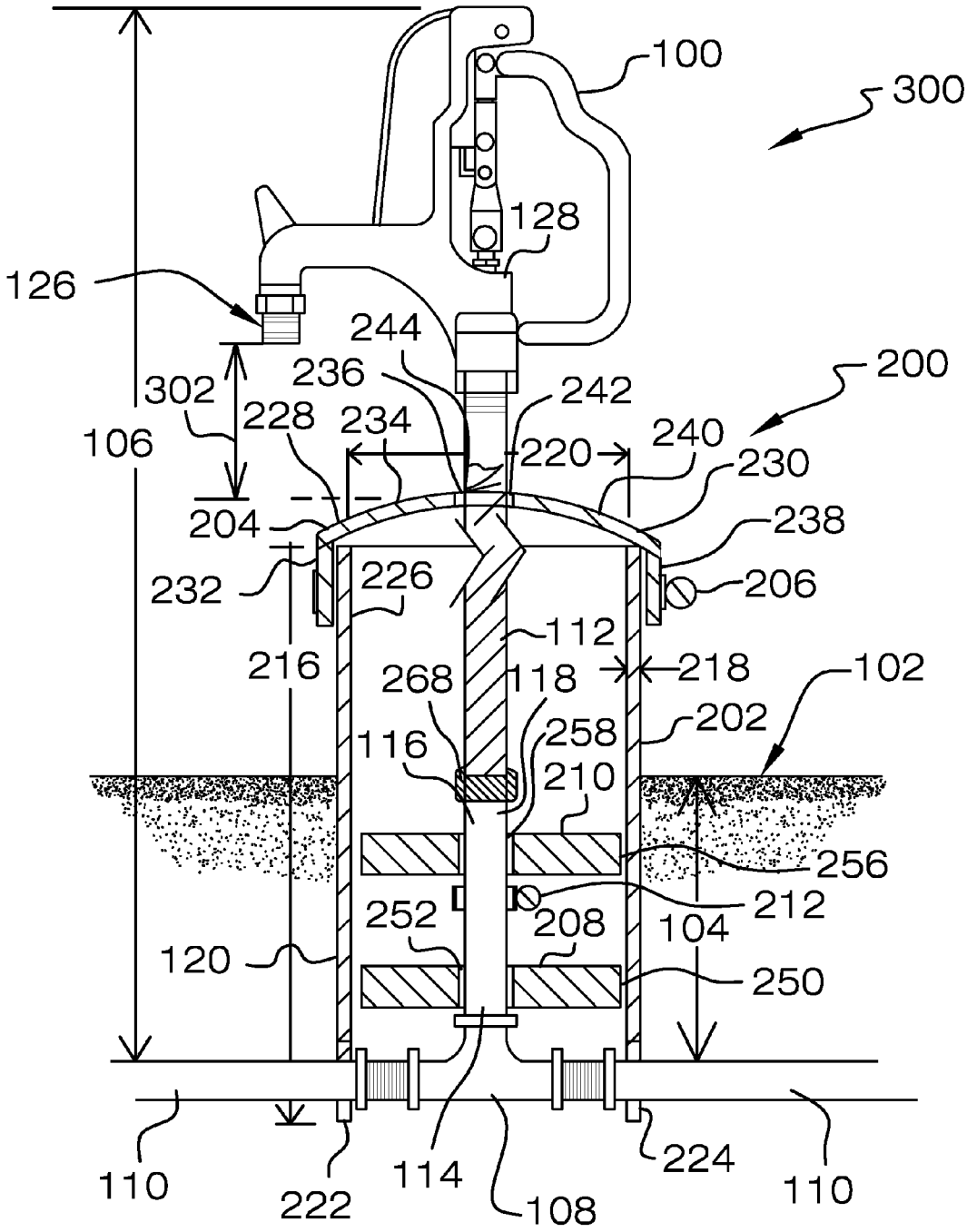
FIG. 2 is an elevated, partial cross sectional view of support structure 200 installed about yard hydrant 100.
Figure 3:
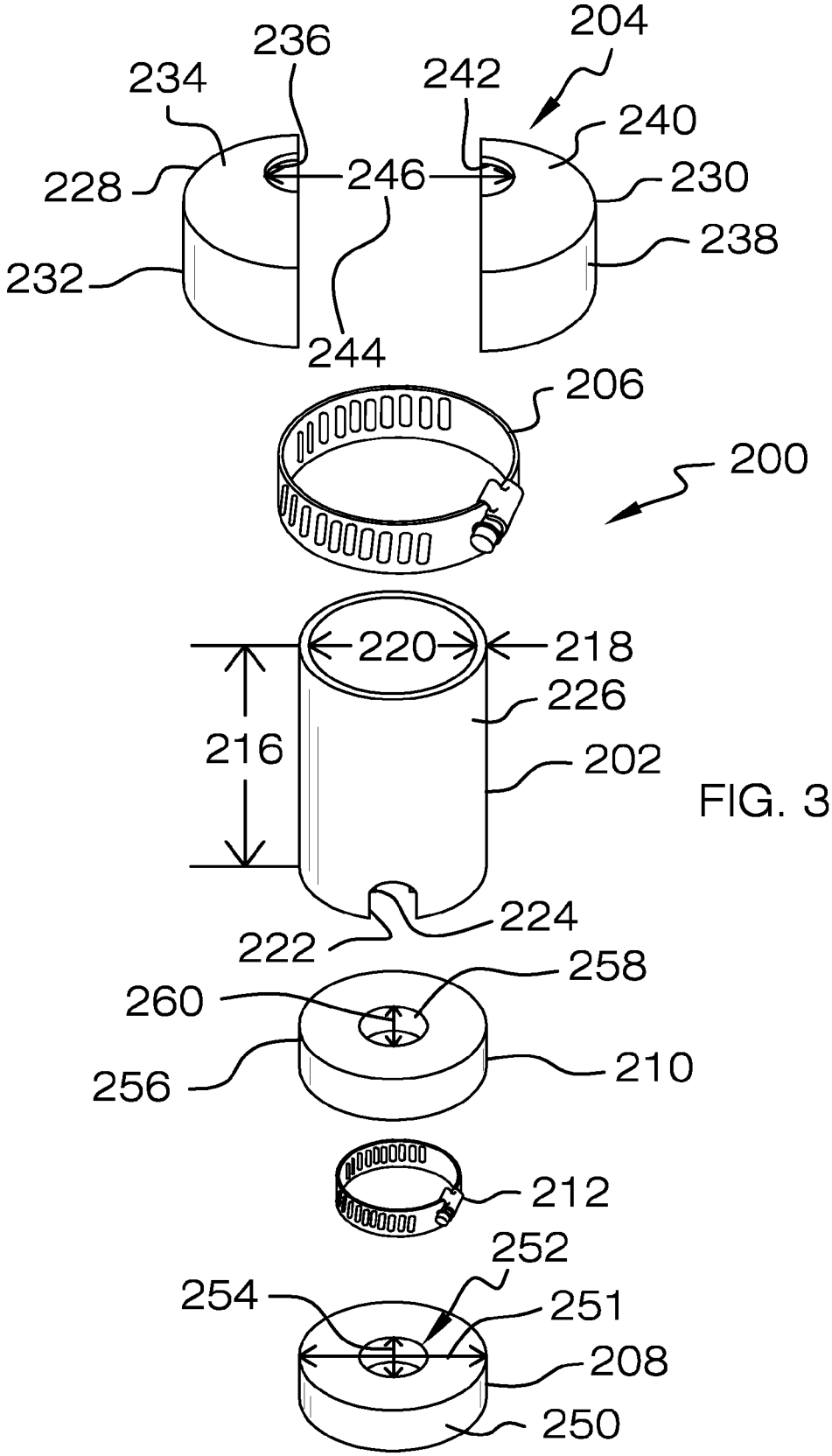
FIG. 3 is an isometric view of each item included with support structure 200.

FIG. 2 is an elevated, partial cross sectional view of support structure 200 installed about yard hydrant 100. FIG. 3 is an isometric view of each item included with support structure 200. Support structure 200 may include a casing 202, a cap 204, a cap clamp 206, a first spacer 208, a second spacer 210, and a second spacer clamp 212. Each item may be utilized with the other items to support the millions of yard hydrants already installed in ground 102 or to support yard hydrants to be installed in ground 102.

Casing 202 may be though of as an annular tube having a length 216, a thickness 218, and an interior diameter 220. In general, length 216, thickness 218, and interior diameter 220 may be chosen as a function of the particular yard hydrant 100 about which support structure 200 may be installed. For example, length 216 of casing 202 may be five feet, interior diameter 220 may be four inches, and casing 202 may be a polyvinyl chloride (PVC) pipe. Such sizing may best suit a yard hydrant 100 having a burry depth 104 of 3½ feet and an overall length 106 of almost seven feet, with 3½ fee of casing 202 located below ground 202 and 1½ feet of casing 202 located above ground. Thickness 218 and interior diameter 220 may be substantially equal throughout casing 202 and an external surface and internal surface of casing 202 may be smooth throughout length 216 and free from burrs, threads, or other disruptions to the smooth character of casing 202.

Casing 202 may include two cutouts: cutout 222 (FIG. 3) and cutout 224. Cutouts 222, 224 may permit casing 202 to fit over a tee joint 108 and register against a supply line 110 in a vertical direction. By not attaching casing 202 to supply line 110, casing 202 may be free to move slightly should casing 202 be bumped by a tractor or person. In other words, casing 202 may be configured to fit over a joint in supply line 110 and register against supply line 110 in a downward vertical direction while remaining free to move slightly in a horizontal direction and an upward vertical direction relative to supply line 110. This may avoid damaging hard hydrant 100.

Cutouts 222, 224 may have a U-shape with the U portion being solid and meeting at an open space. Cutouts 222, 224 may oppose each other and have a substantially identical shape. Casing 202 may include two additional cutouts for a total of four cutouts to permit casing 202 to fit over and register against a second supply line in those situations where three-way tee joint 108 instead is a five-way joint with two perpendicular supply lines and yard hydrant 100 extending from the five-way joint. Cutouts 222, 224 may be large enough to fit over supply line 110.

Casing 202 may be manufactured in a range of colors that convey information about the particular yard hydrant 200. For example, the color of casing 202 may represent the flow rate of yard hydrant 200 or the uses to be made of yard hydrant 200 or not made of yard hydrant 200 (such as use this yard hydrant to water the horses but not the garden to prevent contaminating the garden). A red colored casing 202 may signal a troubled location for a yard hydrant in those situations where a yard hydrant has been replaced multiple times. The color of casing 202 may convey the year of installation for a particular yard hydrant 200 or a multi colored casing 202 may convey the day, month, and year of installation. The exterior of casing 202 may include a reflective coating or sparkling to warn near by tractors and livestock that a yard hydrant is near by.

Cap 204 may fit about a top 226 of casing 202. Experiments have shown that a one piece cap construction with or without internal threads makes it too difficult to install and remove yard hydrant 100. Accordingly, cap 204 is a two piece construction and includes a first cap section 228 and a second cap section 230.

First cap section 228 may be identical to the second cap section 230. A wall 232 of first cap section 228 may extend downward from a top 234 having a crescent 236 (FIG. 3) formed therein. Similarly, a wall 238 of second cap section 230 may extend downward from a top 240 having a crescent 242 (FIG. 3) formed therein. First cap section 228 and second cap section 230 may be made from the same material contained in casing 202.

When brought together, first cap section 228 and second cap section 230 may form cap 204 and define a first registration hole 244. A diameter 246 (FIG. 3) of first registration hole 244 may be of a dimension that permits cap 204 to fit snugly about a riser pipe 112 of yard hydrant 100. A snug fit is not a fixed fit. A snug fit may be a close fit such that riser pipe 112 fits closely but still may move within first registration hole 244 with a little effort. Diameter 246 of first registration hole 244 may be 1⅜ inches and an outside diameter of cap 204 may be four inches.

Cap clamp 206 may aid in securing first cap section 228 and second cap section 230 together and against casing 202. Cap clamp 206 may be a stainless steel worm drive clamp, two latches, a marman clamp ring, a t-bolt clamp, or a pipe clamp. For example, a four to five inch hose clamp may be utilized as cap clamp 206. Experiments have shown that any clamping pressure focused directly against riser pipe 112 may damage riser pipe 112. Direct clamping force applied against riser pipe 112 is avoided by placing only cap 204 and casing 202 within a boundary of cap clamp 206.

Experiments also have shown that locking first cap section 228 and second cap section 230 to riser pipe 112 prevents desired relative movement between riser pipe 112 and support structure 200. Because the clamping force of cap clamp 206 is remote from riser pipe 112, support structure 200 desirably may move slightly relative to riser pipe 112 when a user accidentally bumps casing 202. Under such circumstances, support structure 200 may dissipate the flexural strains into ground 102 rather than into yard hydrant 100.

As noted above, support structure 200 may include first spacer 208. First spacer 208 may function to register casing 202 and a first end 114 of a nipple 116 against each other. Nipple 116 may be viewed as a piece of pipe used for making pipe connections. Where tee joint 108 is a ¾ inch tee joint, nipple 116 may be a ¾ inch by six inch brass nipple. Register casing 202 and a first end 114 of a nipple 116 against each other aids in maintaining yard hydrant 100 in a vertical position.

In general, first spacer 208 may be though of as an annular disc having a hole. First spacer 208 may define a round perimeter 250 (FIG. 3) with an outside diameter 251 and have material removed to define a second registration hole 252. An inside diameter 254 of second registration hole 252 may be of a dimension that permits first spacer 208 to fit snugly about nipple 116. For example, outside diameter 251 may be 3⅞ inches and inside diameter 254 may be 1⅛ inches. A snug fit may be a close fit such that nipple 116 fits closely but still may move within second registration hole 252 with a little effort. First spacer 208 may rest against tee joint 108 when installed over nipple 116. First spacer 208 may be flat and made of plastic, wood, or a combination thereof.

Second spacer 210 may function to register casing 202 and a second end 118 of nipple 116 against each other. This aids in maintaining yard hydrant 100 in a vertical position. Second spacer 210 may define a round perimeter 256 and have material removed to define a third registration hole 258. A diameter 260 (FIG. 3) of third registration hole 258 may be of a dimension that permits second spacer 210 to fit snugly about nipple 116. Second spacer 210 may be flat and made of plastic, wood, or a combination thereof and have similar dimensions as first spacer 208.

Second spacer clamp 212 may support second spacer 210 at second end 118 when installed over nipple 116 to prevent second spacer 210 from sliding down nipple 116. Second spacer clamp 212 may be a stainless steel worm drive clamp, two latches, a marman clamp ring, a t-bolt clamp, or a pipe clamp. For example, second spacer 210 may sit on top of a one inch hose clamp as second spacer clamp 212.

Figure 4:
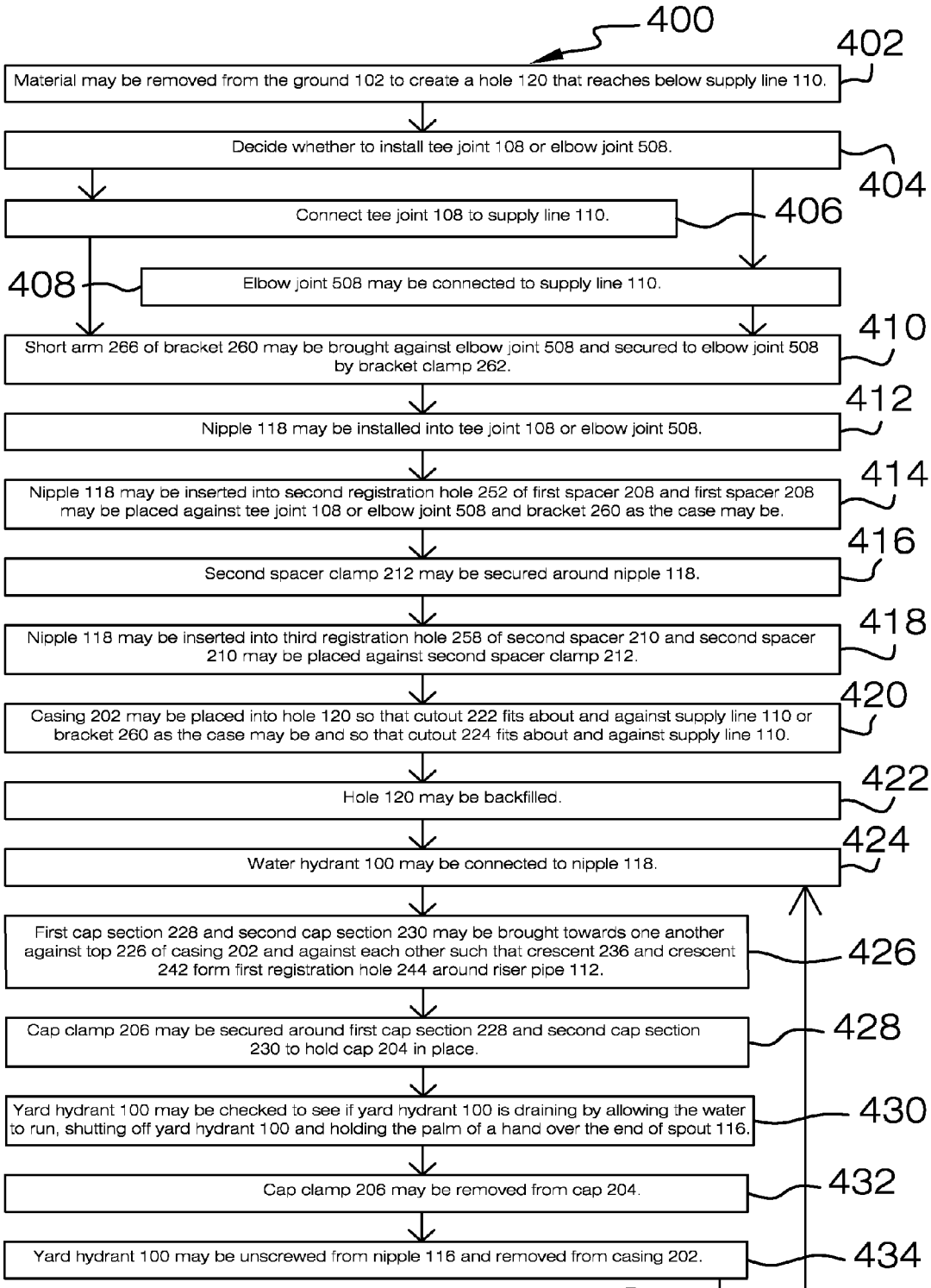
FIG. 4 is a method 400 to install support structure 200 about yard hydrant 100 to form assembly 300.

FIG. 4 is a method 400 to install support structure 200 about yard hydrant 100 to form assembly 300. Visually, the results of such an installation may be seen in FIG. 2.

At step 402, material may be removed from ground 102 to create a hole 120 that reaches below supply line 110. Under some circumstances, tee joint 108 may be installed into supply line 110. However, there may be circumstances where yard hydrant 100 may be installed at an end of supply line 110. The elbow joint lacks the balancing support provided by tee joint 108 to first spacer 208 and casing 202. To provide this balancing support, support structure 200 may include additional elements.

Figure 5:
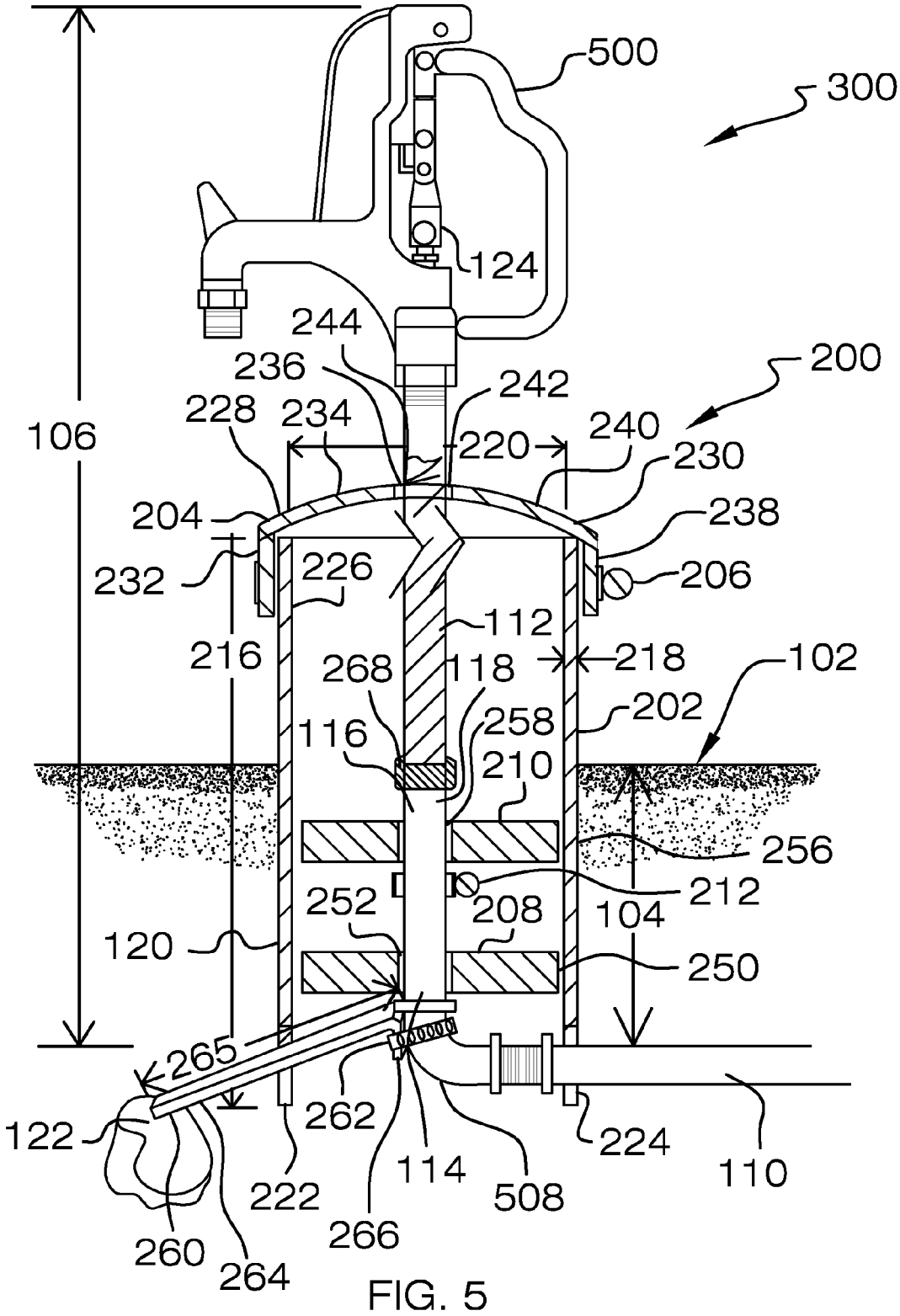
FIG. 5 is an elevated, cross sectional view of support structure 200 installed about yard hydrant 500.

FIG. 5 is an elevated, cross sectional view of support structure 200 installed about yard hydrant 500. Yard hydrant 500 may include the same components as yard hydrant 100, except that instead of tee joint 108, yard hydrant 500 may include an elbow joint 508. To provide a balancing support for first spacer 208 and casing 202, support structure 200 may include a bracket 260 and a bracket clamp 262.

Bracket 260 may be a rigid structure substantially in the shape of an L having an elongated arm 264 connected to a short arm 266. Elongated arm 264 may have a length 264 that is greater than one half of interior diameter 220 of casing 202.

Bracket clamp 262 may secure short arm 266 against elbow joint 508. This may cause elongated arm 264 to extend away from elbow joint 508 beyond cutout 222 of casing 202 to a support 122 in ground 102. Support 122 may be a rock, board, or ground 102 itself. With bracket 260 positioned against elbow joint 508 and support 122, both cutout 222 of casing 202 and first spacer 208 may rest against and be supported by bracket 260.

Returning to FIG. 4, from step 402, method 400 may proceed to step 404. At step 404, method 400 may decide whether to install tee joint 108 or elbow joint 508. If tee joint 108 is to be installed, then method 400 may connect tee joint 108 to supply line 110 at step 406 and proceed to step 412. If elbow joint 508 is to be installed, then method 400 may proceed to step 408. At step 408, elbow joint 508 may be connected to supply line 110. At 410, short arm 266 of bracket 260 may be brought against elbow joint 508 and secured to elbow joint 508 by bracket clamp 262. Method 400 may now proceed to step 412.

At step 412, nipple 118 may be installed into tee joint 108 or elbow joint 508. At step 414, nipple 118 may be inserted into second registration hole 252 of first spacer 208 and first spacer 208 may be placed against tee joint 108 or elbow joint 508 and bracket 260 as the case may be. At step 416, second spacer clamp 212 may be secured around nipple 118. At step 418, nipple 118 maybe inserted into third registration hole 258 of second spacer 210 and second spacer 210 may be placed against second spacer clamp 212.

At step 420, casing 202 may be place into hole 120 so that cutout 222 fits about and against supply line 110 or bracket 260 as the case may be and so that cutout 224 fits about and against supply line 110. At step 422, hole 120 may be backfilled. Water hydrant 100 may be connected to nipple 118 at step 424. This may be achieved by screwing riser pipe 112 onto nipple 116.

At step 426, first cap section 228 and second cap section 230 may be brought towards one another against top 226 of casing 202 and against each other such that crescent 236 and crescent 242 form first registration hole 244 around riser pipe 112. Cap clamp 206 may be secured around first cap section 228 and second cap section 230 at step 428 to hold cap 204 in place.

At step 430, yard hydrant 100 may be checked to see if yard hydrant 100 is draining by allowing the water to run, shutting off yard hydrant 100 and holding the palm of a hand over the end of spout 116. If suction is felt, then yard hydrant 100 is draining.

Typically, proper adjustment of yard hydrant 100 should allow unrestricted flow when a valve 124 is open, no seepage past valve 124 when valve 124 is closed, proper draining of riser pipe 112 when valve 124 is closed, and no leakage through valve 124 drain holes when valve 124 is open. Since backfilling is not required inside casing 202, adjustment of yard hydrant 100 may be done after backfilling step 220. This is an improvement over the conventional adjusting step which requires that the adjustment of yard hydrant 100 be done before backfilling.

When installed according to method 400, a distance 302 between cap 204 and hose thread 126 remains constant from one installation to the next. A reason for this is that casing 202 is registered against supply line 110 and cap 204 is registered against casing 202. Also, yard hydrant 100 is maintained in a vertical position because casing 202 is registered against supply line 110 and first registration hole 244, second registration hole 252, and third registration hole 258 each are held in position effectively by casing 202. These registration holes in turn hold riser pipe 112 in a perpendicular position relative to supply line 110, whether tee joint 108 (FIG. 2) or elbow joint 508 (FIG. 5) is being used. The support of ground 102 that conventionally was applied directly against a buried portion of riser pipe 112 now may be applied against nipple 116 and a section of riser pipe 112 that is located more close to a head assembly 128 of yard hydrant 100.

Method 400 of FIG. 4 may continue where there is an need to remove and replace a yard hydrant within support structure 200. At step 432, cap clamp 206 may be removed from cap 204. At step 434, yard hydrant 100 may be unscrewed from nipple 116 and removed from casing 202. Importantly, yard hydrant 100 may be unscrewed from nipple 116 and removed from casing 202 without the need to dig a new hole 120 into ground 102. Method 400 may return to step 424 to install a new yard hydrant 100 into support structure 200.

Support structure 200 may be supplied with or without a yard hydrant 100. Casing 202 may have legs that extend radially outward between cutout 222 and cutout 224 to add additional stabilizing support. Casing 202 may be a manufactured as single piece such as by injection molding. The steps of method 400 may be performed in different sequences as need and other factors may dictate.

Appealing features of support structure 200 include an information conveying appearance and the protection and accessibility it provides to yard hydrant 100. Support structure 200 may be used in most existing yard hydrant installations. Once installed support structure 200 works towards providing a measure of protection for riser pipe 112. Support structure 200 also may endow yard hydrant 100 with a more substantially and aesthetically pleasing appearance.

Should a yard hydrant freeze with support system 200 installed, cap 204 may be quickly removed and hot water may be poured into casing 202 down the entire outside of riser pipe 112. Water reaching an upper portion of spacer 204 may pass through first resistance hold 250 or outside perimeter 248 of spacer 204, through the through hole 240 of casing 202 and into ground 102. This is a much improved technique in unfreezing a frozen yard hydrant, which conventionally required removing the head assembly 106 and using a copper tube contraption to slowly pour hot water inside the riser pipe.

Should a yard hydrant freeze with support system 200 installed, cap 204 may be quickly removed and yard hydrant 100 then may be unscrewed without having to dig a three plus foot hole in the dead of winter. Thus, installing support system 200 provides the benefit of allowing yard hydrant 100 to be more easily replaced.

The exemplary embodiments described herein are provided merely to illustrate the principles of embodiments and should not be construed as limiting the scope of the subject matter of the terms of the claims. The specification and drawings are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A support structure for a yard hydrant, comprising:

a casing having a first end and a second end, where the first end includes a first cutout and a second cutout adapted to fit about a supply line for the yard hydrant;

a cap adapted to fit around a riser pipe of the yard hydrant;

a cap clamp adapted to secure the cap to the second end of the casing;

a first spacer adapted to fit within the casing and fit about a nipple of the yard hydrant;

a second spacer adapted to fit within the casing and fit about the nipple of the yard hydrant; and a second spacer clamp adapted to support the second spacer.

2. The support structure of claim 1, where the casing is an annular tube having a length, a thickness, and an interior diameter, where the casing is a five foot length of four inch diameter polyvinyl chloride pipe.

3. The support structure of claim 1, where the casing is an annular tube having a thickness and an interior diameter that substantially are equal throughout the casing.

4. The support structure of claim 3 where an external surface and internal surface of the casing is smooth throughout a length of the casing and is free from disruptions to the smooth surfaces of the casing.

5. The support structure of claim 1, where the first end includes a third cutout and a fourth cutout.

6. The support structure of claim 1, where the casing is configured to fit over a joint in a supply line and register against the supply line in a vertical direction while remaining free to move slightly in a horizontal direction and an upward vertical direction relative to the supply line.

7. The support structure of claim 1, where the casing includes a color that conveys information about the yard hydrant.

8. The support structure of claim 1, where the cap includes a first cap section and a second cap section, each without threads, and where the cap clamp is adapted to secure the cap to the second end of the casing without providing any clamping pressure directly against the riser pipe of the yard hydrant.

9. The support structure of claim 8, where the cap includes a first registration hole having a diameter of approximately 1⅜ inches and includes an outside diameter of the cap that approximately is four inches.

10. The support structure of claim 1, where the first spacer is an annular disc having a registration hole, where an outside diameter of the first spacer approximately is 3⅞ inches and an inside diameter the registration hole approximately is 1⅛ inches.

11. The support structure of claim 1, further comprising:

a bracket having an elongated arm and a short arm; and a bracket clamp configured to secure the short arm against an elbow joint of the yard hydrant such that the first cutout of the casing is configured to rest on the elongated arm of the bracket.

12. A method to replace a yard hydrant supported by a support structure, the method comprising:

presenting a support structure (i) having a casing having a first end and a second end, where the first end includes a first cutout and a second cutout fit about a supply line for the yard hydrant, (ii) having a cap secured to the second end of the casing by a cap clamp such that the cap is fit around a riser pipe of the yard hydrant, (iii) having a first spacer fit within the casing and fit about a nipple of the yard hydrant, (iv) having a second spacer fit within the casing and fit about the nipple of the yard hydrant, where the second spacer is supported by a second spacer clamp, where the riser pipe of the yard hydrant is connected to the nipple, where the nipple is connected to a joint that is connected to the supply line;

removing the second spacer clamp;

removing the cap;

removing the yard hydrant from the nipple; and connecting a different yard hydrant to the nipple.

13. The method of claim 12, further comprising:

placing the cap around a riser pipe of the different yard hydrant; and securing the cap to the second end of the casing with a cap clamp.

* * * * *